US006754466B1

(12) United States Patent
Pozniakas

(10) Patent No.: US 6,754,466 B1
(45) Date of Patent: Jun. 22, 2004

(54) TONER REMOVAL APPARATUS FOR COPIER OR PRINTER

(75) Inventor: Robert S. Pozniakas, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 30 days.

(21) Appl. No.: 10/338,960

(22) Filed: Jan. 8, 2003

(51) Int. Cl.[7] ..... G03G 21/00
(52) U.S. Cl. ..... 399/355
(58) Field of Search ..... 399/92, 98, 99, 399/353, 354, 355, 359

(56) References Cited

U.S. PATENT DOCUMENTS

| | | | | |
|---|---|---|---|---|
| 2,832,977 A | | 5/1958 | Walkup et al. | |
| 3,572,923 A | | 3/1971 | Fisher et al. | |
| 3,722,018 A | | 3/1973 | Fisher | |
| 3,780,391 A | | 12/1973 | Leenhouts | |
| 3,969,785 A | * | 7/1976 | Ogawa et al. | 15/301 |
| 4,435,073 A | | 3/1984 | Miller | |
| 4,851,880 A | | 7/1989 | Ziegelmuller et al. | |
| 5,210,582 A | * | 5/1993 | Lundy et al. | 399/349 |
| 5,233,399 A | * | 8/1993 | Shiino et al. | 399/353 |
| 5,315,358 A | | 5/1994 | Parks et al. | |
| 5,381,218 A | * | 1/1995 | Lundy | 399/352 |
| 5,479,249 A | * | 12/1995 | Jugle et al. | 399/349 |
| 5,771,424 A | * | 6/1998 | Lindblad et al. | 399/71 |

FOREIGN PATENT DOCUMENTS

| | | | | |
|---|---|---|---|---|
| JP | 56138769 A | * | 10/1981 | G03G/21/00 |
| JP | 59146079 A | * | 8/1984 | G03G/21/00 |

* cited by examiner

*Primary Examiner*—Robert Beatty
(74) *Attorney, Agent, or Firm*—Robert Chittum; E. D. Palazzo

(57) ABSTRACT

A toner removal apparatus for a reproducing machine has a cylindrical brush mounted for rotation in a closely fitting housing. The housing has an open side confronting a moving photoreceptor. Brush fibers extend through the housing open side into interfering contact with the photoreceptor and sweep toner therefrom. A slot in the housing parallel to the brush is connected to a vacuum source to draw air into the housing open side, through the brush fibers, and out the housing slot. First and second parallel bars are mounted on opposite sides of the housing slot and extend into contact with the brush fibers. The first bar compresses and then releases the brush fibers to flick toner therefrom. The second bar extends into the housing a lesser amount than the first bar and contacts the brush fibers without compression thereof, thereby providing an air seal, so that all of the air flows through the brush fibers.

10 Claims, 4 Drawing Sheets

TONER REMOVAL APPARATUS FOR COPIER OR PRINTER

BACKGROUND OF THE INVENTION

The present invention relates to electrostatographic copiers or printers and, more particularly, to an improved toner removal apparatus for cleaning residual toner from the surface of the photoreceptor of a copier or printer.

Xerography is one type of electrostatographic process, and in the xerographic process, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner being electrostatically attracted to the latent electrostatic image areas to create a visible replica of the original. The developed image is then usually transferred from the photoreceptor surface to a final support material, such as paper, and the toner image is fixed thereto to form a permanent record corresponding to the original.

In a typical xerographic copier or printer, a photoreceptor surface is generally arranged to move in an endless path through the various processing stations of the xerographic process. When the photoreceptor surface is reusable, the toner image is then transferred to a final support material, such as paper, and the surface of the photoreceptor is prepared to be used once again for the reproduction of a copy of an original. Although a preponderance of the toner image is transferred to the paper during the transfer operation, some of the toner forming the image is unavoidably left behind on the photoreceptor surface. This remaining toner on the photoreceptor surface after the image transfer is referred to as residual toner. Residual toner also includes any patches or bands of toner not transferred to the final support material. Many typical copiers or printers use particularly placed and developed patches or bands of toner for process control, and these patches or bands of toner must also be removed by the toner removal apparatus. Thus, all residual toner must be removed from the photoreceptor to prevent degrading subsequent copies reproduced by the copier or printer. Optimally, the residual toner is removed without redepositing the toner onto the photoreceptor or smearing the toner on the photoreceptor surface as an unacceptable film.

One widely accepted method of cleaning residual toner from the surface of a photoreceptor of a typical copier or printer is by means of a cylindrical brush rotated in contact with the photoreceptor surface at a relatively high rate of speed. U.S. Pat. No. 2,832,977 discloses a rotatable brush mounted in close proximity to the photoreceptor surface to be cleaned and the brush is rotated so that the brush fibers continually wipe across the photoreceptor. In order to reduce the dirt level within the copier, a vacuum system is provided which pulls loosely held residual toner from the brush fibers and exhausts the toner from the copier. To assist the vacuum system in removal of the residual toner, the brush fibers are treated with a neutralizing ion spray from a corona generating device. This ion spray is intended to negate any triboelectrification generated when the brush wipes across the photoreceptor surface. Unfortunately, the brush became contaminated with toner after extended usage and had to be replaced more frequently than desired. With increased processing speeds of copiers and printers, the foregoing brush cleaning technique was not practical without improvements.

U.S. Pat. No. 3,572,923 discloses a cylindrical fibrous brush similar to the above mentioned patent, however, after the photoreceptor surface is cleaned, a second cleaning operation is performed on the cleaning brush in which residual toner collected on the brush is electrostatically transferred from the brush fibers to a biased transfer member. To provide appropriate electrostatic relationship between the cleaning members, the brush fibers are mounted on a non-conductive core and the brush is biased to attract toner from the photoreceptor surface to the brush.

U.S. Pat. No. 3,722,018 discloses a more efficient residual toner cleaning system by positioning a corona generating device in the residual toner cleaner of U.S. Pat. No. 3,572,923 to induce a charge on the brush fibers and toner thereon of a polarity opposite that of a biased transfer roll, so that the toner collected by the brush are efficiently transferred from the brush to the roll. U.S. Pat. No. 3,780,391 discloses that toner removal from the brush can also be accomplished by the use an electrically biased flicker bar.

U.S. Pat. No. 4,435,073 discloses a rotatable cylindrical brush cleaning apparatus for removing toner particles from a photoconductive surface. The brush is supported for rotation in a housing. The housing has an opening confronting the photoconductive surface and an aperture communicating through a conduit with a vacuum source. The brush extends from the housing opening into contact with the photoconductive surface. A plurality of flicker bars are mounted in the interior of the housing and in an air stream created by the vacuum source. The flicker bars are fabricated from materials which will not only cause the brush fibers to become electrostatically charged through wiping contact with the bars, but will cause the charge on the brush to reverse at least once for each revolution of the brush.

U.S. Pat. No. 4,851,880 discloses a rotating cylindrical brush and vacuum cleaning apparatus for removing toner particles from an image-bearing surface of a copier or printer. A housing that surrounds and substantially encloses the brush has an open portion adjacent the image-bearing surface. The brush extends through open portion of the housing and into engagement with the image-bearing surface. The rotation of the brush is in a direction opposite the direction of movement of the image-bearing surface. An elongated slot is located in the housing generally opposite the open portion and connects the interior of the housing to a vacuum source. Adjacent to the slot and on the interior of the housing is an airfoil to compress the brush fibers as the brush rotates thereby to loosen the toner particles in the brush fibers collected from the image-bearing surface. This loosening of the toner particles allows the vacuum to extract the toner particles through the housing slot. In an alternate embodiment, an additional airfoil of equal size is provided on the opposite side of the slot. The two airfoils compress the brush fibers on both sides of the slot and forces the air stream generated by the vacuum source to flow through brush fibers from opposite directions prior to exiting the housing through the slot.

U.S. Pat. No. 5,315,358 discloses one or more rotatable cylindrical brushes mounted in a housing having an opening therein to enable the brush or brushes to extend therefrom and into contact with a moving photoconductive surface to remove toner particles therefrom. A flicker bar is removably mounted within the housing and has an integral air channel therein. A vacuum source connected to the air channel in the flicker bar withdraws air and particles from the brush and housing. The solitary construction of the flicker bar provides a properly sized air channel that does not vary due to assembly tolerances.

Though several of the prior art residual toner cleaning devices provide successful residual toner removal, none of the prior art devices prevent excessive wear of the cleaning brushes, prevent toner filming, or enable effective cleaning with reduced air flow and thus less costly vacuum sources.

SUMMARY OF THE INVENTION

It is an object of the present invention to a more efficient toner removal apparatus for cleaning residual toner from a moving photoreceptor that enables a longer cleaning brush life and a reduced vacuum source size.

It is another object of the invention to provide an improved toner removal apparatus having an electrically biased, cylindrical brush mounted for rotation about its axis in a close fitting housing, the housing having an opening through which the brush extends into contact with a moving photoreceptor containing residual toner on the surface thereof and where air may enter, an air slot in the housing through which air may exit, a vacuum source connected to the housing slot for generating an air flow through the housing and brush fibers, and a pair of different-sized, parallel bars located on opposite sides of the slot, one bar for compressing and releasing the brush fibers as the brush rotates therepast to flick or throw toner collected therefrom, and the other bar being smaller and subsequently contacting the brush fibers without compression thereof in order to serve as an air seal.

In one aspect of the invention, there is provided an improved toner removal apparatus for a reproducing of the type having a movable photoreceptor, comprising: an electrically biased, cylindrical brush having a conductive sleeve with fibers radially extending therefrom and an axial shaft, said brush being mounted for rotation about the shaft in a housing; the housing having an opening through which the brush fibers extend into interfering contact with a surface of photoreceptor containing toner thereon and where air may enter, the housing having a slot through which air may exit; a vacuum source connected to the housing slot for generating an air flow through the housing and brush fibers; and a pair of parallel, different-sized flicker bars, each bar of said pair of bars being located on opposing sides of the housing slot, one bar being mounted on the upstream side of the housing slot relative to the brush direction of rotation, so that the brush fibers are compressed and released as the brush rotates therepast to flick or throw toner therefrom, and the other bar being smaller and located on the downstream side of the housing slot, so that the brush fibers contact the smaller bar prior to return of the brush fibers to their original length after being compressed by the upstream bar, the contact of the brush fibers with the smaller bar causing substantially no compression of the brush fibers, whereby the smaller flicker bar serves as an air seal.

In another aspect of the present invention, there is provided an improved toner removal apparatus for cleaning residual toner from the surface of a photoreceptor of a copier or printer as the photoreceptor surface is moved therepast, said toner removal apparatus comprising: a cylindrical brush having an axis and radially extending fibers, said brush being adapted for rotation about said axis; a housing substantially surrounding said brush and having a generally cylindrical interior surface closely adjacent the brush to provide minimal to substantially zero space between the brush and the housing interior surface, said housing having an open portion confronting the photoreceptor surface through which the brush fibers extend into interfering contact with said photoreceptor surface, so that rotation of the brush sweeps residual toner from the moving photoreceptor surface, said housing having an elongated slot therethrough substantially parallel to the axis of said brush and located at a position spaced from said housing open portion, the slot having parallel sides formed in the housing interior surface, one slot side being upstream from the from the other slot side relative to the direction of rotation of said brush; a vacuum source connected to said housing slot for creating an air flow into the housing through said open portion, through the brush fibers, and out through the housing slot; and first and second parallel flicker bars being located on opposite sides of said slot, the first flicker bar being located on said upstream slot side and extending into a predetermined distance into said housing and into interfering contact with the brush fibers, the second flicker bar extending into the housing a distance less that the first flicker bar and into less interfering contact with the brush to form an air seal without substantially compressing the brush fibers.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
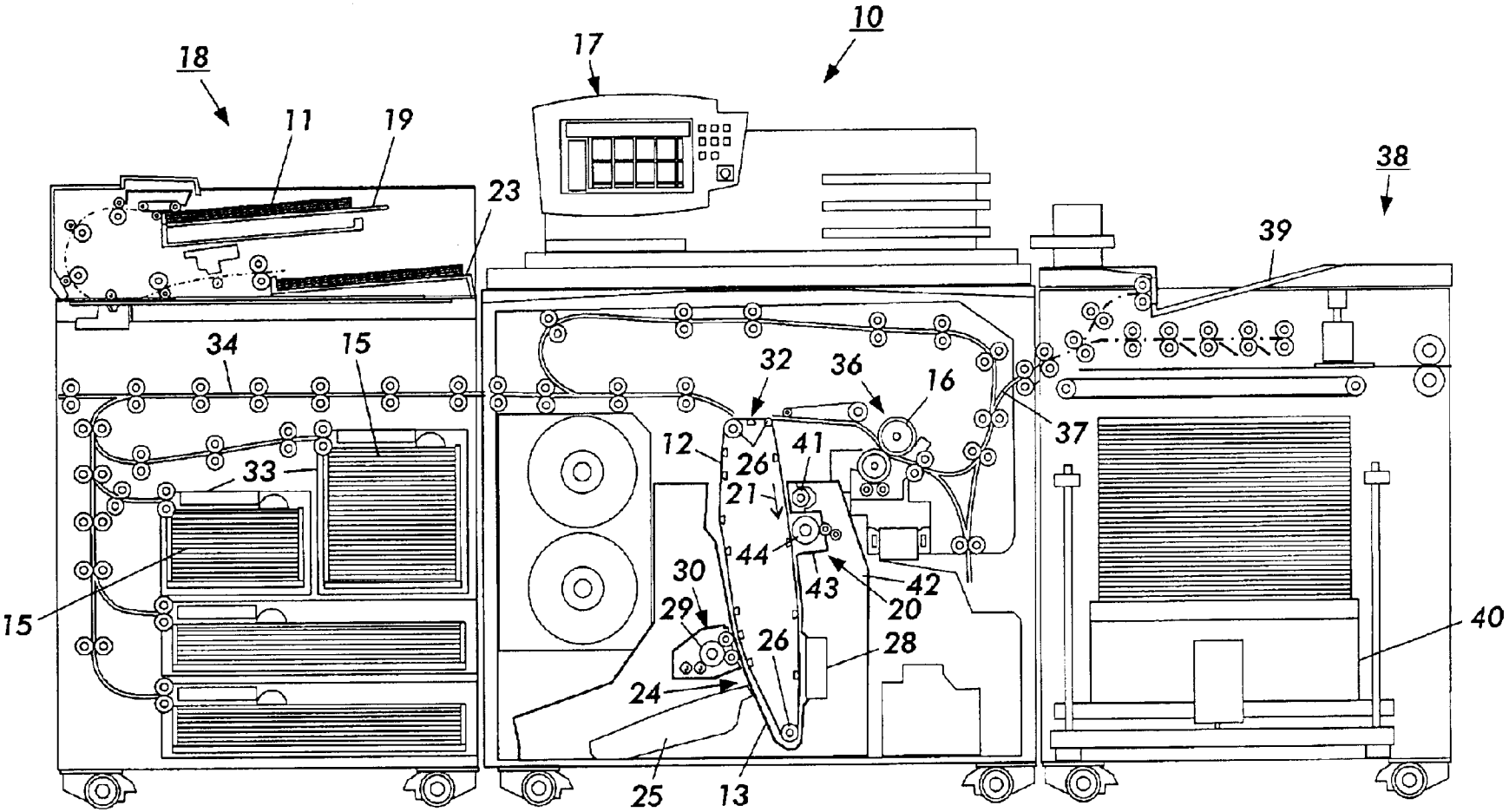
FIG. 1 is a schematic front elevation view of a high speed reproducing machine shown in cross-section, incorporating the present invention therein, with the processing components of the machine shown in cross-section to better illustrate the environment for the present invention.

For a general understanding of a high-speed, electrophotographic reproducing machine 10, incorporating the toner removal apparatus 20 of the present invention, refer to FIG. 1. The various processing components for the high-speed, reproducing machine, also referred to as a copier or printer, are schematically illustrated to show the environment and function of the toner removal apparatus in the production of copies of an original document by such machine. As in all electrophotographic machines, including the high-speed type illustrated in FIG. 1, a light image of an original document 11 to be reproduced is projected or scanned onto a uniformly charged surface 13 of a photoreceptor 12 to form an electrostatic latent image thereon. Thereafter, the latent image is developed with an oppositely charged developing material called toner (not shown) to form a toner image, corresponding to the latent image on the photoreceptor surface. The toner image is then electrostatically transferred to a final support material, such as paper 15, to which it may be permanently fixed by a fusing device 16. The electrostatic transfer of the toner image causes most of the toner image to be adhered to the paper, but some residual toner 14 (see FIG. 2) is left on the photoreceptor surface. This residual toner must be removed prior to reusing that portion of the photoreceptor to prevent unacceptable subsequent reproduced images. The present invention relates to a residual toner removal apparatus 20 that must not only effectively clean residual toner from the photoreceptor, but must do so in a cost effective manner. One important cost effective feature is that the apparatus must be capable of a long life and not require maintenance or replacement until many copies have been reproduced; e.g., two million copies.

In the illustrated machine 10 of FIG. 1, a set of original documents 11 to be copied is placed on tray 19 of an automatic document handler 18. The machine operator enters the desired copying instructions, such as, for example, number of copies or sets of copies, through the control panel 17. The automatic document handler transports the documents 11 serially from the tray and past a scanning station 22 where each document is scanned thereby producing digital image signals corresponding to the informational areas on the original document. Once scanned, the documents are deposited in an output tray 23. The image signals are projected upon the uniformly charged surface of the photoreceptor at an imaging station 24 by a raster output system 25 to form a latent electrostatic image of the scanned informational areas of the original document thereon as the photoreceptor is moved passed the imaging station. The photoreceptor 12 is shown in the form of a flexible, endless belt, but may also be in the form of a rigid drum. Whether the photoreceptor is in the form of a belt or drum, it has a photoconductive outer surface. The photoreceptor belt configuration shown in FIG. 1 has a photoconductive outer surface 13 on a conductive backing layer 27 (see FIG. 2) and is mounted on a set of rollers 26. At least one of the rollers is driven to move the photoreceptor in the direction indicated by arrow 21 at a constant rate of speed about the rollers and past the various xerographic processing stations. Prior to entering the imaging station 24, the photoreceptor surface 13 is uniformly charged at a charging station 28 with positive or negative charges from a charge generator, such as for example, a corona generating device (not shown). In this embodiment, the uniform charge is positive.

The exposure of the charged surface of the photoreceptor to the digital signals at the imaging station discharges the photoreceptor surface in the areas struck by the digital image signals. Thus, there remains on the photoreceptor surface a latent electrostatic image in image configuration corresponding to the informational areas on the original. As the photoreceptor continues its movement, the latent electrostatic image thereon passes through developing station 30 having a developer assembly 29. The developer assembly deposits oppositely charged toner on the latent electrostatic image to form a toner image.

The photoreceptor movement is continued, transporting the toner image from the developer station to a transfer station 32. A sheet of copy paper 11 is fed from a paper supply 33 to a sheet transport 34 for travel to the transfer station. The paper is moved at a speed in synchronism with the moving photoreceptor and into aligned and registered contact with the toner image. Transfer of the toner image to the paper is effected and the paper with the toner image is stripped from the photoreceptor and conveyed to a fusing station 36 having fuser assembly 16 where the toner image is fused to permanently fix the toner image to the paper.

After the toner image is fixed to the paper, the paper is transported by sheet transporting mechanism 37 to a finishing station 38 where the paper with the image may be collected in a tray 39 or collated and stapled into volumes and deposited on platform 40. The final station of the reproducing machine is a cleaning station 42 where the residual toner removal apparatus 20 of the present invention is positioned. In the preferred embodiment of the invention, a pre-cleaning corona generating device 41 applies charges to the residual toner to make sure the residual toner has a significant charge, thereby aiding in an effective removal of the toner. Neutral or weakly charged toner will not be sufficiently attracted to the brush 44 of the toner removal apparatus 20. As discussed later with reference to FIG. 2, the toner removal apparatus comprises an electrically biased rotating brush 44 mounted in a close fitting housing 43. The rotating brush concurrently sweeps and attracts the residual toner 14 from the photoreceptor. The brush is rotated in a direction opposite to that of the photoreceptor movement, as indicated by arrows 35, and the brush fibers carry the residual toner away. The housing has an elongated aperture or slot 56 (see FIG. 2) that is connected to a vacuum source (not shown). A pair of different sized bars (not shown in this view) is mounted in the housing adjacent and parallel to opposing sides of the slot The residual toner is extracted from the brush and housing by the compression and release of the brush fibers by the larger of the bars, which causes the toner to be flicked or thrown from the fibers. The smaller bar of the pair of bars subsequently contacts the brush fibers without significant compression thereof to form a seal, so that the air flow generated by the vacuum source passes through the brush fibers and carries away the released toner.

Suitable drive means (not shown) are arranged to drive the photoreceptor in timed relationship to the scanning of the original document and forming the latent electrostatic image on the photoreceptor, to effect development of the latent electrostatic image, to separate and feed sheets of paper, to transport same through the transfer station in time registration with the toner image, and to convey the sheet of paper with the toner image through the fusing station to fix the toner image thereto, and to remove the residual toner from the photoreceptor in a timed sequence to produce copies of the original documents.

The foregoing description is believed to be sufficient for the purposes of showing the general operation of a high-speed and high-volume reproducing machine, as well as defining the operating environment of the toner removal apparatus of the present invention. Thus, it is clear that high speed, high volume reproducing machines quickly generate large quantities of residual toner that require effective removal in a cost effective manner.

Figure 2:
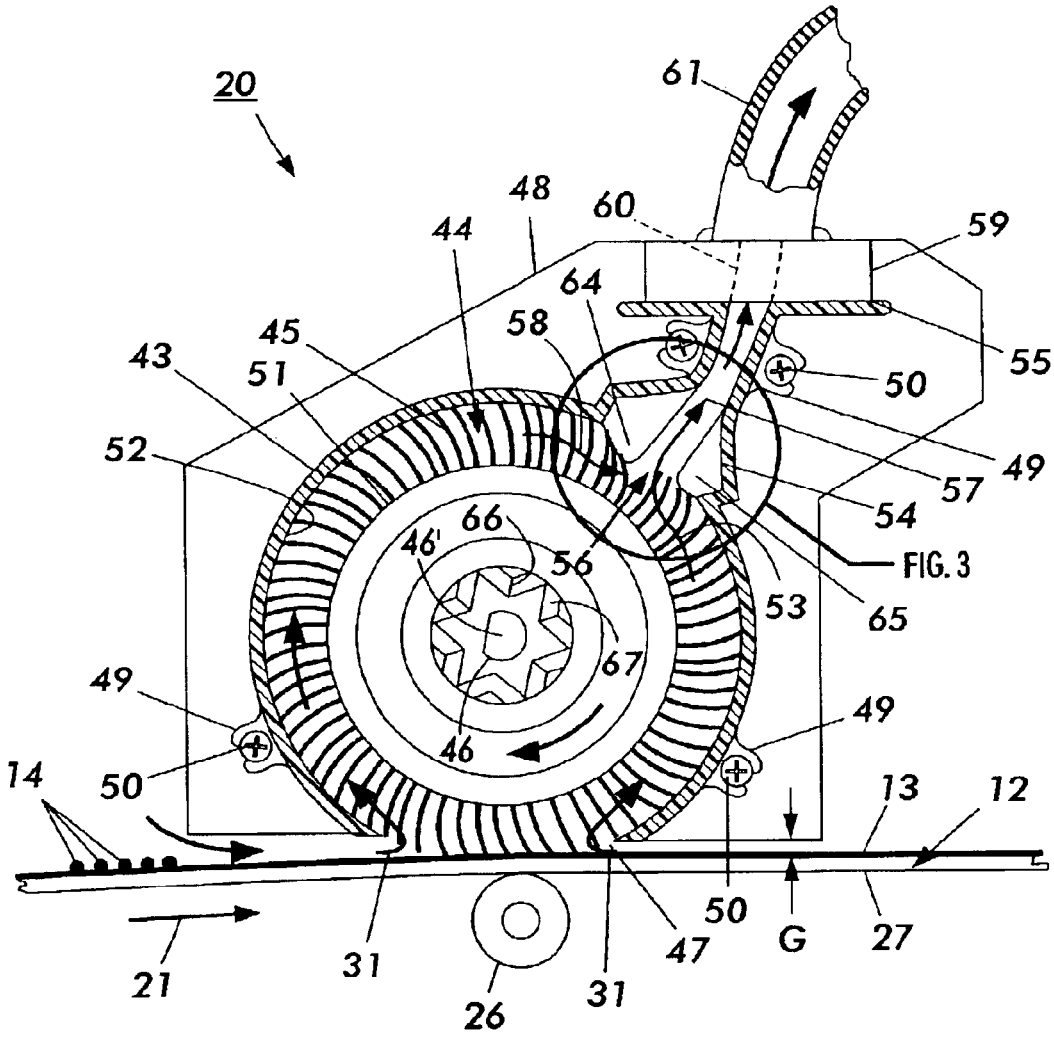
FIG. 2 is a cross-sectional elevation view of the toner removal apparatus of the present invention as shown in FIG. 1.

In FIG. 2, the preferred embodiment of the toner removal apparatus 20 is shown in a cross-sectional elevation view having a single brush arrangement. The brush 44 is cylindrically shaped and is adapted for rotation about its axis 46' by shaft 46 at 200–300 RPM. The toner removal apparatus has a close fitting aluminum housing 43 that substantially surrounds the rotatable brush 44. The interior surface 52 of the housing is spaced from the brushes by 0 to 0.75 mm, so that the gap between the ends of the brush fibers and the interior surface 52 of the housing ranges from a zero distance to a minimal distance. This gap between the housing interior surface and brush fibers minimizes the space in the housing for the passage of air without the air flowing through the brush fibers. As explained later, the air exiting from the housing through the slot 56 must travel through the brush fibers that are adjacent slot 56. The housing 43 is fastened to a fixed frame member 48 of the reproducing machine 10 by any suitable means, such as, for example, integral housing flanges 49 and screws 50.

The side portion 47 of the housing that confronts the photoreceptor 12 is open and the brush fibers 45 extend therefrom into interfering contact with the photoreceptor surface 13. The housing open side portion confronts the photoreceptor surface 13 and is parallel to and spaced therefrom by about 3–5 mm, as indicated by the distance identified as G. The space G between the housing open side portion 47 and photoreceptor surface 13 permits air to enter the housing, as indicated by arrows 31. The brush has an overall diameter of about 60 mm with fibers 45 extending radially from a conductive sleeve 51 for a distance of about 13 mm. The brush has an electrical bias of about 250 volts and when negatively charged toner is used for developing latent electrostatic images, as is used in machine 10 of FIG. 1, the bias voltage is positive. The brush sleeve has internal splines 66 that mate with external splines 67 on the drive shaft 46, so that the drive shaft rotates the sleeve with substantially no backlash, while permitting easy installation and removal of the brush from the toner removal apparatus. Drive shaft 46 is rotated by any suitable drive mechanism (not shown), such as, for example, an electric motor. The brush fibers have a diameter of 10 denier or about 35 $\mu$m and contacts the photoreceptor surface with an interference of about 2.5 mm. The combination of the electrical bias of the brush and the sweep or wipe of the brush fibers against the photoreceptor surface effectively cleans and removes the residual toner therefrom.

The housing 43 has an elongated extension 54 that extends substantially along the length of the housing and terminates in a flange 55. The extension 54 contains therein an elongated passageway 57. The cross-sectional area of the passageway 57, as viewed along the length of the housing 43, is substantially parallel to the brush 44 and has about the same size and shape as that of the housing slot 56. The housing slot 56 is an elongated opening having a length about the length of brush 44 with parallel sides that are substantially parallel to the brush. The passageway provides a means for air to flow between the housing interior 52 and through the flange 55. The flange 55 is pressed against a cover 59 having on aperture 60 therein. A conduit 61, shown partially in section, is attached to the cover and surrounds the cover aperture 60 to place the housing interior into communication with a vacuum source (not shown).

Figure 3:
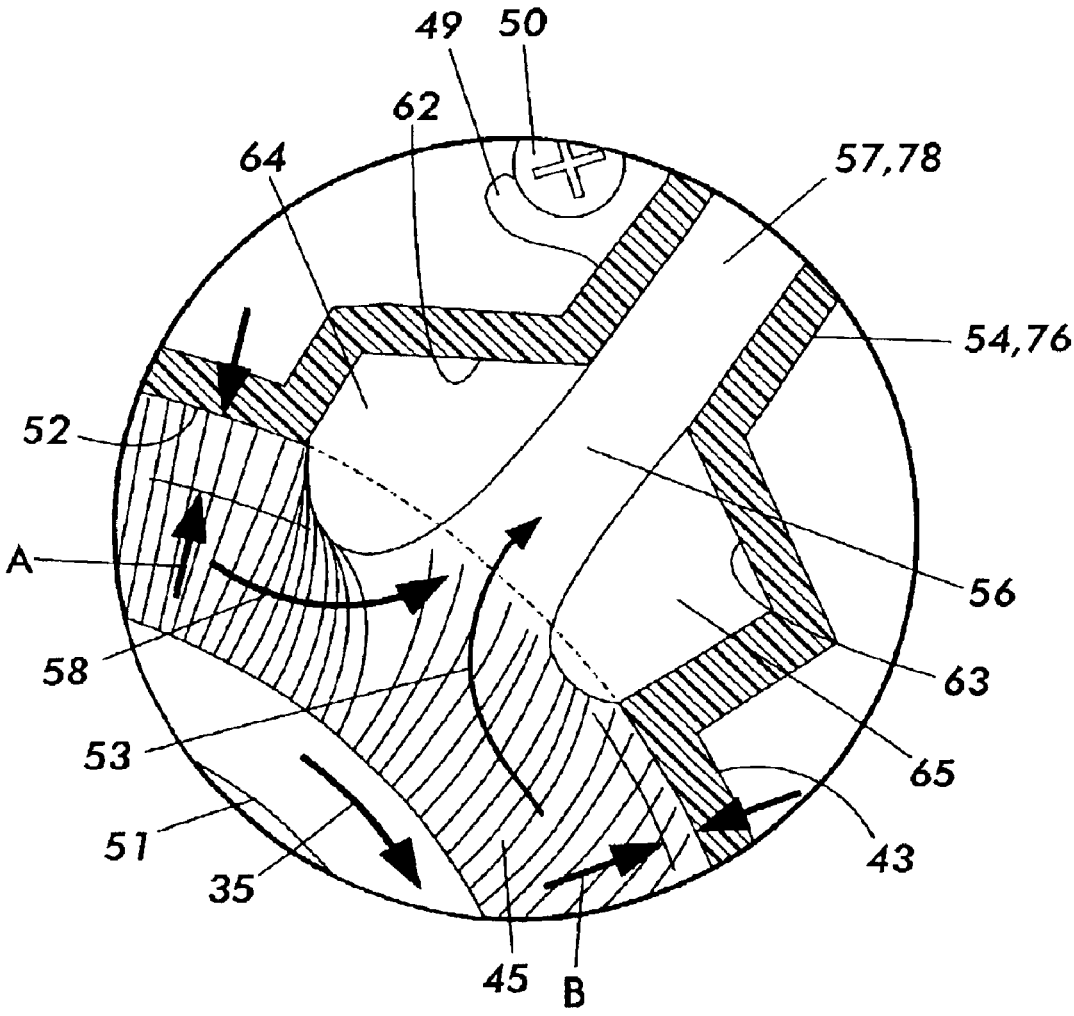
FIG. 3 is an enlarged, partially shown cross-sectional view of the flicker bar and associated air sealing bar of the toner removal apparatus identified in FIG. 2 as circled area 3—3.

Referring also to FIG. 3, parallel recesses 62, 63 are located on opposing sides of the housing slot 56 and at the entrance to the passageway in the extension 54. A flicker bar 64 is located in the recess 62 on the upstream side, relative to the motion of the brush 44, as indicated by arrow 35. A sealing bar 65 is located in the recess 63 on the downstream side of the housing slot. The flicker bar extends into interfering contact with the rotating brush 44. The amount of interference by the flicker bar with the brush fibers is about 3 mm, as indicated by distance 'A'. As the brush fibers rotate past the flicker bar, the brush fibers are deformed and compressed, so that once the brush fibers have passed from contact with the flicker bars, the brush fibers begin to straighten towards their original vertical position. However, the straightening of the brush fibers is time dependent, so the fibers do not reach their original straight position until well is past the sealing bar. It has been determined that the sealing bar 65 must extend into the chamber for about 1.25 mm, as indicated by the distance 'B', in order to contact the still slightly deformed brush fibers and yet not cause any compression of the brush fibers. This minimal contact of the brush fibers with the sealing bar prevents air from traveling unimpeded above the brush fibers and through the housing slot 56 and into the passageway 57. Thus, the sealing bar serves to force the air flow generated by the vacuum source to pass through the brush fibers. For sufficient residual toner removal, air flow generated by the vacuum source though the housing of the toner removal apparatus is usually around 30 feet per second or about 25 cubic feet per minute (cfm). It has been estimated that about two thirds of the air flow entering the passageway passes through the brush fibers in contact with the sealing bar, as indicated by arrow 53, while the remaining about one third of the air flow passes through the brush fibers compressed by the flicker bar, as indicated by arrow 58.

The flicker bar and sealing bar may be any suitable material having low friction, is non-wearing on the brush fibers, and toner will not film on it. In the preferred embodiment, a high-density polyethlyene was found to be a suitable for the bars. Any suitable brush fiber material may be used, such as, for example, nylon or acrylic fibers. The brush fibers for the preferred embodiment is SA-7® from the Toray Company Many prior art residual toner cleaning devices have used flicker bars, and it is known to use two equally sized flicker bars that are mounted on each side of the air flow exit slot in the brush housings. The latter configuration accomplishes the task of forcing air through the brush fibers, but it has been found to wear out the residual toner cleaning brushes faster. It also restricts the air flow to such an extent that much larger and more costly vacuum sources are required. Rapidly deteriorating brushes are not cost effective, because in addition to the cost of the new brushes, they usually are installed by skilled technicians as opposed to copier users. Worn brushes do not effectively remove the residual toner, and it is well known that residual toner that is not completely removed causes poor subsequent image reproduction.

Figure 4:
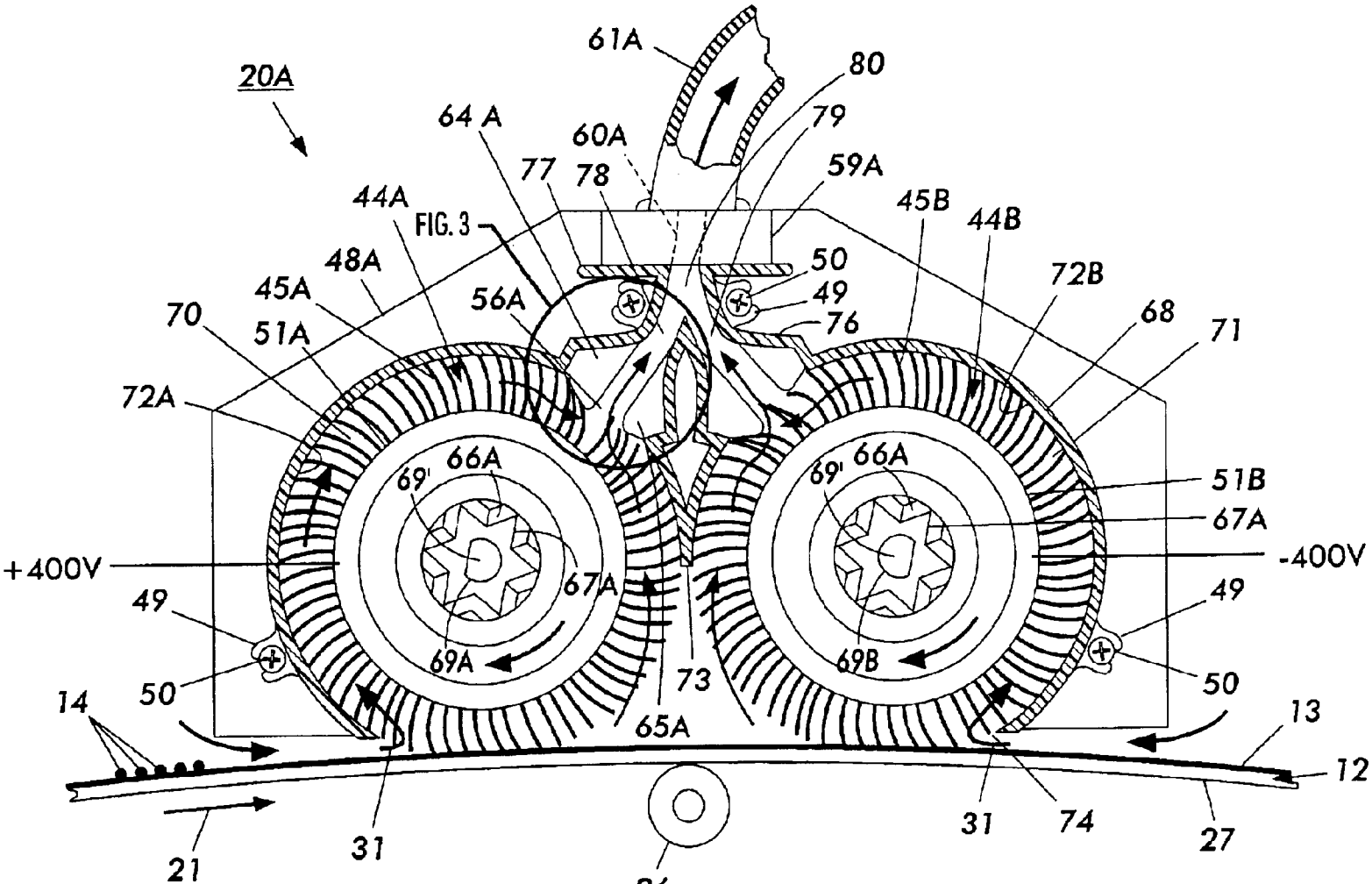
FIG. 4 is a cross-sectional elevation view of an alternate embodiment of the toner removal apparatus having at least two rotating brushes.

In FIG. 4, a cross-sectional elevation view of an alternate embodiment of the present invention is shown having a two-brush arrangement. In the toner removal apparatus 20A shown in FIG. 4, the brushes 44A, 44B are cylindrically shaped and identical to the brush 44 shown in FIG. 2. The brushes are rotatably mounted in housing 68, are parallel to each other, and are adapted for rotation about their axes 69' by shafts 69A,69B at 200–300 RPM. The toner removal apparatus of this embodiment has a close fitting, aluminum housing 68 that has an internal, cylindrical chamber 70,71 for each brush. Each housing chamber substantially surrounds a respective brush 44A,44B. The interior surface 72A,72B of each respective housing chamber is spaced from the brushes by 0 to 0.75 mm. As in the embodiment of FIG. 2, the gap between the brushes 44A,44B and the chamber interior surfaces 72A,72B ranges from zero to 0.75 mm. The portion of the housing chambers adjacent each other share a common wall 73.

The side portion 74 of the housing 68 that confronts the photoreceptor 12 is open and the brush fibers 45A,45B extend therefrom into interfering contact with the photoreceptor surface 13. The housing open portion 74 confronting the photoreceptor surface is parallel to and spaced therefrom by about 1–5 mm, and preferably about 3 mm. The space between the housing open side 74 permits air to enter the housing, as indicated by arrows 31. Each brush has an overall diameter of about 60 mm with fibers 45A,45B extending radially from a conductive sleeve 51A,51 B for a distance of about 13 mm. Each of the brushes has an electrical bias of about 400 volts and a polarity determined by the charge on the toner. When the toner charge is bipolar, as in this alternate embodiment, the electrical bias of brush 44*a* is positive and the electrical bias of brush 44B is negative. Similar to the single brush arrangement in FIG. 2, the brush sleeves 51A,51B have internal splines 66A that mate with external splines 67A on the drive shafts 69A,69B, so that the drive shafts rotate their respective sleeves with substantially no backlash, while permitting ready installation and removal from the toner removal apparatus 20A. The drive shafts 69A,69B are concurrently rotated by any suitable drive means (riot shown). The brush fibers have a diameter of 10 denier or about 35 μm. The brush fibers of brushes 44A,44B contact the photoreceptor surface 13 with an interference of about 2.5 mm, so that the combination of electrical bias and the sweep or wipe of fibers of each brush against the photoreceptor surface cleans and removes the residual toner therefrom.

The housing 68 has an elongated extension 76 that extends substantially along the length of the housing and terminates in a flange 77. The housing extension 76 contains therein two elongated passageways 78,79 that extend from respective chambers 70,71 and converge to a single aperture 80 in the flange 77. The elongated cross-sectional areas of the passageways 78,79, as viewed along the length of the housing 68, are respectively substantially parallel to the brushes 44A,44B and each passageway has about the same size and shape as the respective chamber slots 56A,56B. The passageways provide a flow path between the housing chambers and the vacuum source (not shown) through the flange 77. The flange 77 is pressed against a cover 59A which has an aperture 60A therein. A conduit 61A, shown partially in section, is attached to the cover aperture 60A to complete the communication path between the housing chambers and the vacuum source.

In a similar manner to that discussed above with respect to the flicker bar 64 and sealing bar 65 of FIG. 2, parallel recesses 62A,63A are located on opposing sides of each chamber slot 56A,56B and at the entrance of the respective passageways 78,79 in the housing extension 76. Since this area, identified by circle 3—3 in FIG. 4, is the same for both housing chambers 70,71, and is identical to the same area of FIG. 2, detailed discussion will be omitted of flicker bars and sealing bars. It is thus sufficient to indicate that flicker bar 64A and sealing bar 65A are located in respective recesses 62A,63A as shown in FIG, 3. The flicker bar and sealing bar for housing chamber 71 is identical to the flicker bar of housing chamber 70 as well as that shown in FIG. 2 for a single brush arrangement. The flicker bars and sealing bars of FIG. 4 extend into their respective housing chambers for the same respective distances as indicated in FIG. 3 by the distances A and B. In a like manner, the brush fibers are compressed and deformed by the flicker bars and the sealing bars extend into the respective chambers for the distance required to contact the brush fibers before they have not had time to straighten after being deformed by the flicker bars. As discussed before, this slight contact of the brush fibers with the sealing bar prevents air from entering the extension passageways without passing through brush fibers. Thus, the sealing bars cause the air flow generated by the vacuum source to pass through the brush fibers without significantly increasing the vacuum source size or causing excess wear on the brushes.

Various distances of extension into the housing by the sealing bar were investigated for a toner removal brush having a diameter of about 60 mm with fibers about 13 mm long to determine how much contact with the brush fibers were necessary to achieve maximum benefits. It was found that air flow impedance increased significantly without much gain in toner removal when the sealing bar extended into the housing for more than about 1.25 mm. If the sealing bar extended into the housing less than 1.0 mm most of the air flow did not pass through the brush fibers before exiting from the brush housing and toner began to build up in brush fibers. With the sealing bar extending into the housing about 1.25 mm, a significant reduction in toner accumulation was found. During a test where at least 5,000 copies were run on the high speed, high volume reproducing machine of the type described herein, the weight gain in residual toner stabilized, thereby indicating a long usage capability without affecting toner removal ability or inadequately removing residual toner from the photoreceptor.

Although the foregoing description illustrates the preferred embodiment, other variations are possible and all such variations as will be apparent to those skilled in the art are intended to be included within the scope of this invention as defined by the following claims.

What is claimed is:

1. An improved toner removal apparatus for a reproducing machine of the type having a moving photoreceptor, comprising:

an electrically biased, cylindrical brush having a conductive sleeve with fibers radially extending therefrom and an axial shaft, said brush being mounted for rotation about the shaft in a housing;

said housing having an opening through which the brush fibers extend into interfering contact with a surface of the moving photoreceptor containing toner thereon and where air may enter, the housing having a slot through which air may exit;

air generating means connected to the housing slot for generating an air flow through the housing and brush fibers; and a pair of different sized bars, each bar of said pair of bars being located on opposing sides of the housing slot, the bars being parallel to each other and the brush shaft, said pair of bars extending into the housing and into contact with the brush fibers, one bar of said pair of bars compressing and subsequently releasing the brush fibers as the brush is rotated therepast to flick or throw toner collected from the photoreceptor towards the housing slot, and the other bar being smaller and contacting the brush fibers without compressing and releasing the brush fibers, in order to provide an air seal that causes the air to flow through said brush fibers being contacted by both of said bars without substantially increasing air flow impedance.

2. The toner removal apparatus as claimed in claim 1, wherein said housing opening is spaced about 3 to 5 mm from the moving photoreceptor surface; wherein said brush fibers extend into interfering contact with said moving photoreceptor surface for about 2.5 mm; and wherein said housing has an interior surface spaced from said brush fibers by about 0 to 0.75 mm.

3. The toner removal apparatus as claimed in claim 2, wherein said brush has a conductive sleeve having a surface from which the fibers extend for about 13 mm; wherein the fibers have a diameter of about 35 μm; and wherein said brush has an electrical bias of about 250 volts.

4. The toner removal apparatus as claimed in claim 3, wherein said brush is rotated about the brush shaft at about 200 to 300 RPM; and wherein the overall diameter of said brush is about 60 mm.

5. The toner removal apparatus as claimed in claim 4, wherein said brush sleeve has internal splines that mate with external splines on a drive shaft rotated by a suitable drive mechanism, whereby the drive shaft rotates said sleeve with substantially no backlash, while permitting easy installation and removal of said brush.

6. The toner removal apparatus as claimed in claim 1, wherein said air generating means is a vacuum source; and wherein said vacuum source generates an air flow through the housing of about 30 feet per second.

7. The toner removal apparatus as claimed in claim 1, wherein said pair of bars is comprised of first and second bars, the first bar extending into said housing a distance of about 3 mm, thereby providing sufficient interfering contact with said brush fibers to function as a flicker bar to compress and release the brush fibers as said brush is rotated therepast, the second bar extending into said housing a distance of about 1.25 mm to contact the brush fibers without compression thereof, the second bar contacting the brush fibers subsequent to the interfering contact of the brush fibers with the first bar and before the brush fibers have time to straighten to the original position of said brush fibers.

8. The toner removal apparatus as claimed in claim 7, wherein said first and second bars are located in respective recesses on opposing sides of said housing slot.

9. An improved toner removal apparatus for cleaning residual toner from the surface of a photoreceptor of a reproducing machine as the photoreceptor surface is moved therepast, comprising:

a cylindrical brush having an axis and radially extending fibers, said brush being adapted for rotation about said axis;

a housing substantially surrounding said brush and having a generally cylindrical interior surface closely adjacent the distal ends of said brush fibers, said housing having on open portion confronting the photoreceptor surface through which the brush fibers extend into interfering contact with said photoreceptor surface, so that rotation of the brush sweeps residual toner from the moving photoreceptor surface, said housing having an elongated slot therethrough substantially parallel to the axis of said brush and located at a position spaced from said open portion, the slot having parallel sides formed in the housing interior surface, one side of the slot being upstream from the other slot side relative to the direction of rotation of said brush;

a vacuum source connected to said housing slot for creating an air flow into the housing through said open portion thereof, the air flow traveling through the brush fibers and out the housing slot; and first and second parallel bars being located on opposite sides of said housing slot, the first bar being located on said upstream slot side and extending into a predetermined distance into said housing and into interfering contact with the brush fibers, so that the brush fibers are compressed and subsequently released by said first bar as the brush rotates therepast to flick or throw residual toner from the brush fibers into the housing slot upon the release from the first bar, the second bar extending into the housing a distance less than that of the first bar and into contact with the brush fibers without compression thereof to form an air seal that causes the air to flow through the brush fibers and prevent some air flow from exiting over the brush fibers that not returned to their original straight position subsequent to their release from the first bar.

10. An improved toner removal apparatus for a high volume reproducing machine of the type having a moving photoreceptor, comprising:

first and second electrically biased, cylindrical brushes, each first and second brush having a conductive sleeve with fibers radially extending from a surface thereof and an axial shaft, the shafts of said first and second brushes being parallel to each other;

a housing having adjacent first and second parallel chambers with a common wall therebetween, said first brush being mounted for rotation about its shaft in the first chamber of the housing, said second brush being mounted for rotation about its shaft in the second chamber of the housing, said first and second chambers each having an opening through which the fibers of the first and second brushes extend into interfering contact with a surface of the moving photoreceptor containing toner thereon and where air may enter, the first and second chambers having respective first and second slots through which air may exit;

an elongated extension having first and second elongated passageways, said first and second passageways each having opposing ends, one end of the first passageway being connected to the first slot and one end of the second passageway being connected to the second slot, the opposing ends of the first and second passageways converging into a single aperture;

a vacuum source being connected to said single aperture for generating an air flow through the first and second chambers of said housing and fibers of said respective first and second brushes therein; and first and second pairs of different-sized bars, each bar of said first pair of bars being located on opposing sides of the first chamber slot, each bar of said second pair of bars being located on opposing sides of the second chamber slot, each of the bars of said first and second pairs of bars being parallel to each other and the brush shafts, each of said first and second pairs of bars extending into respective first and second chambers of the housing and into contact with the brush fibers of respective first and second brushes, one bar of said first pair of bars compressing and subsequently releasing the brush fibers of the first brush as the first brush is rotated therepast to flick or throw toner collected from the photoreceptor towards the first chamber slot, and the other bar of said first pair of bars being the smaller of the first pair of bars and contacting the brush fibers of the first brush without compressing the brush fibers of the first brush, one bar of said second pair of bars compressing and subsequently releasing the brush fibers of the second brush as the second brush is rotated therepast to flick or throw toner collected from the photoreceptor towards the second chamber slot, and the other bar of said second pair of bars being the smaller of the second pair of bars and contacting the brush fibers of the second brush without compressing the brush fibers of the second brush, so that the smaller bars of the first and second pairs of bars provide an air seal that causes the air to flow through the respective first and second housing chambers and the brush fibers of the respective first and second brushes without substantially increasing air flow impedance.

* * * * *